US010605083B2

(12) United States Patent
Watanabe et al.

(10) Patent No.: US 10,605,083 B2
(45) Date of Patent: Mar. 31, 2020

(54) SCROLL-TYPE FLUID MACHINE AND MAINTENANCE METHOD FOR SAME

(71) Applicant: Hitachi Industrial Equipment Systems Co., Ltd., Chiyoda-ku, Tokyo (JP)

(72) Inventors: Sho Watanabe, Tokyo (JP); Kiminori Iwano, Tokyo (JP); Yoshio Kobayashi, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 186 days.

(21) Appl. No.: 15/505,694

(22) PCT Filed: Nov. 11, 2015

(86) PCT No.: PCT/JP2015/081681

§ 371 (c)(1),
(2) Date: Feb. 22, 2017

(87) PCT Pub. No.: WO2016/080253

PCT Pub. Date: May 26, 2016

(65) Prior Publication Data

US 2018/0216461 A1 Aug. 2, 2018

(30) Foreign Application Priority Data

Nov. 17, 2014 (WO) ..... PCT/JP2014/080291

(51) Int. Cl.

| | |
|---|---|
| ***F03C 2/00*** | (2006.01) |
| ***F03C 4/00*** | (2006.01) |
| ***F04C 18/00*** | (2006.01) |
| ***F01C 1/02*** | (2006.01) |
| ***F01C 21/04*** | (2006.01) |
| ***F01C 21/10*** | (2006.01) |
| ***F01C 17/06*** | (2006.01) |

(Continued)

(52) U.S. Cl.
CPC ..... *F01C 1/0215* (2013.01); *F01C 1/0246* (2013.01); *F01C 17/063* (2013.01);
(Continued)

(58) Field of Classification Search
CPC .. F04C 18/02; F04C 18/0215; F04C 18/0261; F04C 29/02; F04C 29/026; F04C 29/042;
(Continued)

(56) References Cited

U.S. PATENT DOCUMENTS

| | | | |
|---|---|---|---|
| 6,129,531 | A | 10/2000 | Elson et al. |
| 2005/0220649 | A1 | 10/2005 | Sato |

(Continued)

FOREIGN PATENT DOCUMENTS

| | | | |
|---|---|---|---|
| CN | 2153172 | Y | 1/1994 |
| CN | 100347449 | C | 11/2007 |

(Continued)

OTHER PUBLICATIONS

International Search Report (PCT/ISA/210) issued in PCT Application No. PCT/JP2015/081681 dated Feb. 23, 2016 with English translation (Two (2) pages).

(Continued)

*Primary Examiner* — Theresa Trieu
(74) *Attorney, Agent, or Firm* — Crowell & Moring LLP

(57) ABSTRACT

A scroll-type fluid machine and maintenance method for same are provided in order to improve reliability and workability by supplying sufficient grease to necessary parts of an orbiting bearing or auxiliary crank bearing without entailing a complicated operation during maintenance. The scroll-type fluid machine includes a fixed scroll, an orbiting scroll, a casing provided on the outer side of the orbiting scroll in the radial direction, a drive shaft, an orbiting bearing supporting the drive shaft with respect to the orbiting scroll, and a piping supplying a lubricant to the orbiting bearing. The orbiting scroll is provided with a boss plate that is attached to the drive shaft, the piping is provided in the boss plate, and the tip of the piping faces toward an opening provided (Continued)

between the casing and the fixed scroll or toward an opening provided in the fixed scroll or the casing.

21 Claims, 11 Drawing Sheets

(51) Int. Cl.
*F04C 18/02* (2006.01)
*F04C 29/02* (2006.01)

(52) U.S. Cl.
CPC ..... *F01C 21/04* (2013.01); *F01C 21/10* (2013.01); *F04C 18/02* (2013.01); *F04C 29/02* (2013.01); *F04C 2230/80* (2013.01); *F04C 2240/30* (2013.01); *F04C 2240/50* (2013.01)

(58) Field of Classification Search
CPC ..... F04C 2230/80; F04C 2240/30; F04C 2240/50; F04C 2240/807; F01C 1/0215; F01C 1/0246; F01C 17/063; F01C 21/04; F01C 21/10
USPC ..... 418/55.1–55.6, 57, 94, 97–98, 101, 151
See application file for complete search history.

(56) References Cited

U.S. PATENT DOCUMENTS

| | | | |
|---|---|---|---|
| 2006/0171831 | A1 | 8/2006 | Elson et al. |
| 2007/0183915 | A1 | 8/2007 | Guo et al. |
| 2013/0149179 | A1 | 6/2013 | Sato et al. |

FOREIGN PATENT DOCUMENTS

| | | | |
|---|---|---|---|
| CN | 203548218 | U | 4/2018 |
| EP | 1 582 693 | A1 | 10/2005 |
| EP | 1 683 971 | A2 | 7/2006 |
| JP | 7-2961 | Y2 | 1/1995 |
| JP | 2002-227779 | A | 8/2002 |
| JP | 2005-282496 | A | 10/2005 |
| JP | 2012-77670 | A | 4/2012 |
| WO | WO 2012/043099 | A1 | 4/2012 |

OTHER PUBLICATIONS

Japanese-language Written Opinion (PCT/ISA/237) issued in PCT Application No. PCT/JP2015/081681 dated Feb. 23, 2016 (Four (4) pages).

International Search Report (PCT/ISA/210) issued in PCT Application No. PCT/JP2014/080291 dated Mar. 3, 2015 with English translation (Six (6) pages).

Japanese-language Written Opinion (PCT/ISA/237) issued in PCT Application No. PCT/JP2014/080291 dated Mar. 3, 2015 (Four (4) pages).

Extended European Search Report issued in counterpart European Application No. 15860679.8 dated Jun. 5, 2018 (eleven (11) pages).

Chinese-language Office Action issued in counterpart Chinese Application No. 201580045350.2 dated Feb. 24, 2018 with English translation (Twenty-Seven (27) pages).

Korean-language Office Action issued in counterpart Korean Application No. 10-2017-7003886 dated Jun. 12, 2018 with English translation (ten (10) pages).

SCROLL-TYPE FLUID MACHINE AND MAINTENANCE METHOD FOR SAME

TECHNICAL FIELD

The present invention relates to a scroll-type fluid machine and its maintenance method.

BACKGROUND ART

As a background art in the present technical field, there is Patent Literature 1.

Patent Literature 1 describes a scroll-type fluid machine, wherein on a front side of an eccentric shaft part integral with a drive shaft, an oil supply hole facing in a direction of an axial line of an orbiting scroll penetrates through the orbiting scroll so that grease can be supplied from an opening end on a front side of this oil supply hole, i.e., a side of an orbiting lap toward a bearing part of the eccentric shaft part, and, on a front side of a self-rotation preventing mechanism, an oil supply hole facing in a direction of an axial line of an orbiting scroll penetrates through the orbiting scroll so that grease can be supplied from an opening end on a front side of this oil supply hole, i.e., a side of an orbiting lap toward a bearing of the self-rotation preventing mechanism.

CITATION LIST

Patent Literature

PATENT LITERATURE 1: JP-A-2005-282496

SUMMARY OF INVENTION

Technical Problem

In the scroll-type fluid machine described in Patent Literature 1, the oil supply hole faces the front side, i.e., in the direction of the axis line of the eccentric shaft; therefore, the scroll-type fluid machine cannot supply grease unless a fixed scroll is removed, and cannot improve the workability during maintenance.

In view of the above problem, the present invention is intended to provide a scroll-type fluid machine capable of supplying sufficient grease to necessary parts of an orbiting bearing or auxiliary crank bearing without entailing a complicated operation during maintenance, thereby improving the reliability and workability, and its maintenance method.

Solution to Problem

To solve the above problem, the present invention provides a scroll-type fluid machine that includes a fixed scroll, an orbiting scroll that faces the fixed scroll and makes the orbiting movement, a casing that is provided on radially outside of the orbiting scroll, a drive shaft that drives the orbiting scroll, an orbiting bearing that supports the drive shaft with respect to the orbiting scroll, and a piping that supplies lubricant to the orbiting bearing, in which the orbiting scroll is provided with a boss plate that is attached to the drive shaft, the piping is provided on the boss plate, and a distal end of the piping faces an opening part provided between the casing and the fixed scroll or an opening part provided on the fixed scroll or the casing.

Furthermore, the present invention provides a scroll-type fluid machine that includes a fixed scroll, an orbiting scroll that faces the fixed scroll and makes orbiting movement, a casing that is provided on radially outside of the orbiting scroll, a drive shaft that drives the orbiting scroll, and a self-rotation preventing mechanism that prevents self-rotation of the orbiting scroll, in which a boss plate attached to the drive shaft is provided on a surface of the orbiting scroll on an opposite side of a surface facing the fixed scroll, a piping for supplying lubricant to the self-rotation preventing mechanism is provided on the boss plate, and a distal end of the piping faces an opening part provided between the casing and the fixed scroll or an opening part provided on the fixed scroll or the casing.

Moreover, the present invention provides a maintenance method for a scroll-type fluid machine that includes inserting a tool for lubricant supply from an opening part provided between a casing and a fixed scroll or an opening part provided on the fixed scroll or the casing, and supplying lubricant to a first piping, which is provided on a boss plate connecting an orbiting scroll with a drive shaft and supplies lubricant to an orbiting bearing, and/or a second piping, which supplies lubricant to a self-rotation preventing mechanism.

Advantageous Effects of Invention

According to the present invention, it is possible to provide a scroll-type fluid machine with reliability and workability improved.

DESCRIPTION OF EMBODIMENTS

As an example of a scroll-type fluid machine according to the present invention, a scroll-type compressor is described as an example in respective embodiments.

Embodiment 1

Embodiment 1 of the present invention is described on the basis of FIGS. 1 to 7.

Figure 1:
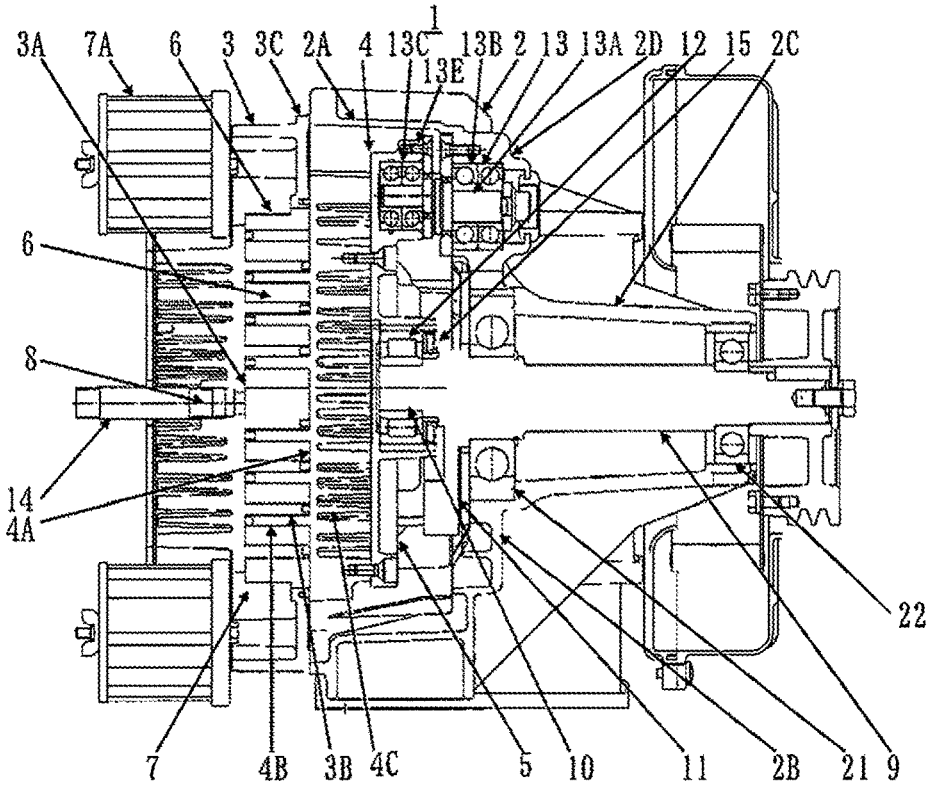
FIG. 1 is a cross-sectional view of a scroll-type compressor according to Embodiment 1 of the present invention.

An entire configuration of a scroll-type compressor according to the present embodiment is explained with FIG. 1. A compressor body 1 uses a scroll-type air compressor, and is composed of a casing 2, a fixed scroll 3, an orbiting scroll 4, a drive shaft 9, a crank part 10, a self-rotation preventing mechanism 13, etc. that are described below.

The casing 2 composing an outer shell of the compressor body 1 is formed into a bottomed tubular shape that one side thereof in an axial direction is closed and the other side in the axial direction is open as shown in FIG. 1. That is, the casing 2 is roughly composed of a tube part 2A that the other side thereof in the axial direction (on the side of the fixed scroll 3 to be described later) is open, an annular bottom part 2B that is integrally formed with the one side of the tube part 2A in the axial direction and extends radially inward, and a tubular bearing attachment part 2C that projects from the inner periphery side of the bottom part 2B toward both sides in the axial direction.

Furthermore, in the tube part 2A of the casing 2, there are housed the orbiting scroll 4, the crank part 10, the self-rotation preventing mechanism 13, etc. that are described later. Moreover, on the side of the bottom part 2B of the casing 2, a plurality of the self-rotation preventing mechanisms 13 (only one self-rotation preventing mechanism 13 is shown in FIG. 1) are arranged at predetermined intervals in a circumferential direction in a space between the bottom part 2B and the side of an end plate 4A of the orbiting scroll 4 to be described later.

The fixed scroll 3 is one of scroll members, and is fixedly installed on the side of an opening end of the casing 2 (the tube part 2A). Then, as shown in FIG. 1, the fixed scroll 3 is roughly composed of an end plate 3A formed into a discoid shape, a spiral lap part 3B installed upright on the front surface of the end plate 3A, and a tubular support part 3C that is installed on the side of the outer periphery of the end plate 3A so as to surround the lap part 3B from the radially outside and is fixed to the side of the opening end of the casing 2 (the tube part 2A) with a plurality of bolts (not shown) or the like.

The orbiting scroll 4 composing the other scroll member is rotatably installed in the casing 2 so as to face the fixed scroll 3 in the axial direction. Then, as shown in FIG. 1, the orbiting scroll 4 is roughly composed of the discoid end plate 4A, a lap part 4B installed upright on the front surface of the end plate 4A, a plurality of cooling fins 4C installed upright on the opposite side of the lap part 4B, and a boss plate 5 that is installed upright on the side of the back surface of the end plate 4A (the surface on the opposite side of the lap part 4B) and is attached to the crank part 10 to be described later through an orbiting bearing 12.

Furthermore, on the radially outside of the boss plate 5, the self-rotation preventing mechanisms 13 are arranged at a predetermined interval in the circumferential direction of the orbiting scroll 4 in a space between the boss plate 5 and the bottom part 2B of the casing 2. Then, the boss plate 5 of the orbiting scroll 4 is placed so that its center radially deviates by a predetermined given dimension (an orbiting radius) from the center of the fixed scroll 3.

A plurality of compression chambers 6 define the border between the lap part 3B of the fixed scroll 3 and the lap part 4B of the orbiting scroll 4. As shown in FIG. 1, the lap part 4B of the orbiting scroll 4 is placed so as to overlap with the lap part 3B of the fixed scroll 3, thereby the compression chambers 6 are formed between these lap parts 3B and 4B sandwiched in between the end plates 3A and 4A.

An intake port 7 is provided on the side of the outer periphery of the fixed scroll 3. The intake port 7 draws in air from the outside through, for example, an air intake filter 7A, etc. and this air is continuously compressed in the compression chambers 6 with the orbiting movement of the orbiting scroll 4.

A discharge port 8 is provided on the side of the center of the fixed scroll 3. The discharge port 8 ejects compressed air from, of the plurality of compression chambers 6, the innermost-diameter-side compression chamber 6 into a storage tank (not shown) to be described later. That is, the orbiting scroll 4 is driven by an electric motor (not shown) or the like through the drive shaft 9 and the crank part 10 that are described later, and makes the orbiting movement with respect to the fixed scroll 3 in a state where self-rotation of the orbiting scroll 4 is restricted by the self-rotation preventing mechanisms 13 to be described later.

Accordingly, of the plurality of compression chambers 6, the outer-diameter-side compression chambers 6 draw in air from the intake port 7 of the fixed scroll 3, and this air is continuously compressed in the compression chambers 6. Then, the inner-diameter-side compression chambers 6 eject the compressed air from the discharge port 8 located on the side of the center of the end plate 3A to the outside.

The drive shaft 9 is rotatably installed in the bearing attachment part 2C of the casing 2 through bearings 21 and 22. The proximal end side (the one side in the axial direction) of the drive shaft 9, which projects out from the casing 2, is detachably connected to a driving source such as an electric motor (not shown), and is driven to rotate by this electric motor. Furthermore, a bearing boss 5A on the boss plate 5 of the orbiting scroll 4 is rotatably connected to the distal end side (the other side in the axial direction) of the drive shaft 9 through the crank part 10 and the orbiting bearing 12 that are described later.

The crank part 10 is integrally installed to the distal end side of the drive shaft 9, and the crank part 10 is connected to the bearing boss 5A of the boss plate 5 of the orbiting scroll 4 through the orbiting bearing 12 to be described later. Then, the crank part 10 rotates integrally with the drive shaft 9, and this rotation is converted into the orbiting movement of the orbiting scroll 4 through the orbiting bearing 12.

The plurality of self-rotation preventing mechanisms 13 are installed between the bottom part 2B of the casing 2 and the back surface side of the orbiting scroll 4 (only one self-rotation preventing mechanism 13 is shown in FIG. 1). Each of the self-rotation preventing mechanisms 13 is composed of, for example, an auxiliary crank shaft 13A and auxiliary crank bearings 13B and 13C; the auxiliary crank bearing 13B is located on the side of the casing 2, and the auxiliary crank bearing 13C is located on the side of the orbiting scroll 4. Then, the auxiliary crank bearings 13B and 13C are housed in bearing bosses 2D and 5B provided on the casing 2 and the boss plate 5 of the orbiting scroll 4, respectively.

Then, the self-rotation preventing mechanisms 13 prevent self-rotation of the orbiting scroll 4, and is subjected to a thrust load from the orbiting scroll 4 on the side of the bottom part 2B of the casing 2. Incidentally, instead of the auxiliary crank mechanism, for example, a ball coupling mechanism or Oldham's coupling can be used to compose the self-rotation preventing mechanisms 13.

A discharge piping 14 is installed so as to be connected to the discharge port 8 of the fixed scroll 3. The discharge piping 14 composes a discharge passage connecting between the storage tank (not shown) and the discharge port 8.

The drive shaft 9 is provided with a balance weight 11 to make the orbiting movement of the orbiting scroll 4 steady, and the balance weight 11 rotates integrally with the drive shaft 9 when the compressor is in operation.

The orbiting bearing 12 is arranged between the bearing boss 5A of the boss plate 5 of the orbiting scroll 4 and the crank part 10. The orbiting bearing 12 is fitted into the bearing boss 5A of the boss plate 5 of the orbiting scroll 4; the orbiting bearing 12 supports the crank part 10 with respect to the boss plate 5, and compensates for the orbiting scroll 4 making the orbiting movement in a given orbiting radius with respect to an axis line of the drive shaft 9.

Figure 2:
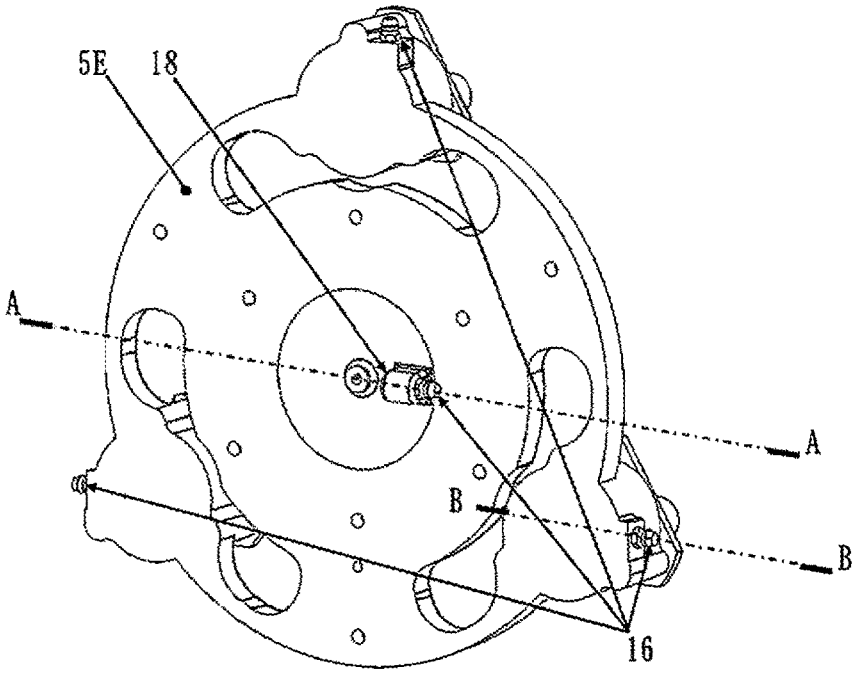
FIG. 2 is a perspective view of a boss plate according to Embodiment 1 of the present invention.
Figure 3:
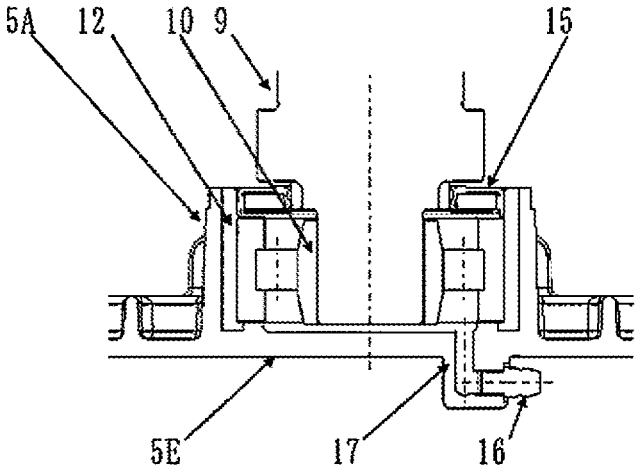
FIG. 3 is a cross-sectional view of the boss plate according to Embodiment 1 of the present invention.
Figure 4:
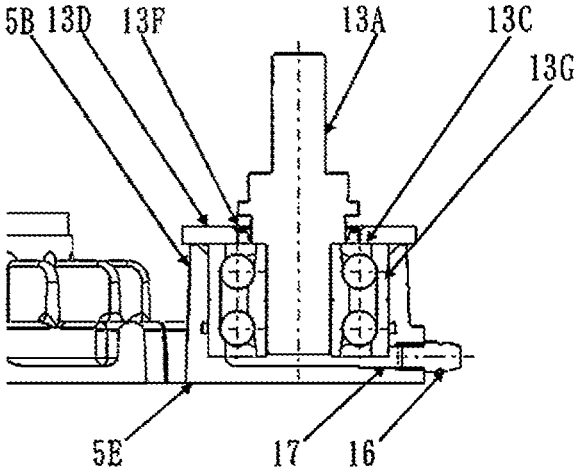
FIG. 4 is a cross-sectional view of the boss plate according to Embodiment 1 of the present invention.

FIG. 2 shows the boss plate 5 according to the present embodiment; FIGS. 3 and 4 show cross-sectional views of the bearing bosses 5A and 5B of the boss plate 5 along lines A-A and B-B, respectively.

The orbiting bearing 12 is surrounded by the bearing boss 5A of the boss plate 5, a seal member 15, and the crank part 10 of the drive shaft 9. The seal member 15 is installed between the bearing boss 5A of the boss plate 5 and the crank part 10 of the drive shaft 9 in order to seal lubricant of the orbiting bearing.

The auxiliary crank bearing 13C is surrounded by the bearing boss 5B of the boss plate 5, a pressure plate 13D, a seal member 13F, and the auxiliary crank shaft 13A. The auxiliary crank bearing 13C is inserted into the bearing boss 5B of the boss plate 5 and rigidly fastened with a countersunk bolt 13E together with the pressure plate 13D. The depth of the bearing boss 5B is smaller than the height of the auxiliary crank bearing 13C, and the pressure plate 13D is fastened with the countersunk bolt 13E, thereby applying pressurization to an outer ring 13G of the auxiliary crank bearing 13C. The seal member 13F is installed between the pressure plate 13D and the auxiliary crank shaft 13A in order to seal lubricant of the auxiliary crank bearing 13C.

Figure 5:
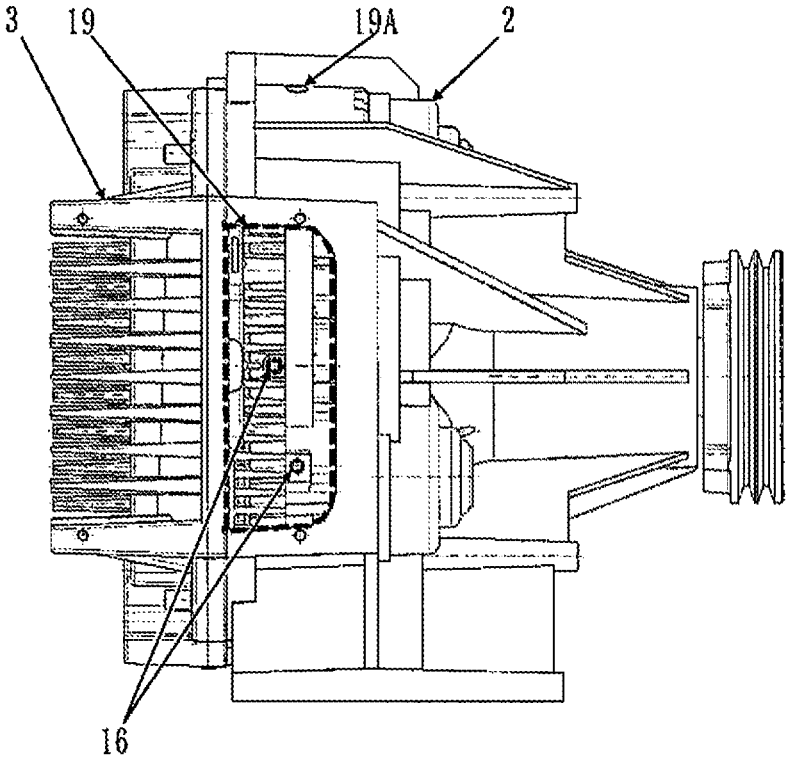
FIG. 5 is a diagram showing the scroll-type compressor according to Embodiment 1 of the present invention.

The present embodiment describes a structure where a lubricant supply passage 17 and a grease nipple 16 are provided as a piping for supplying lubricant to the orbiting bearing 12 and the auxiliary crank bearing 13C through the back and side surfaces of the bearing bosses 5A and 5B on the boss plate 5, and the distal end of the grease nipple 16 faces an opening part 19 shown in FIG. 5; the opening part 19 is composed of the fixed scroll 3 and the casing 2.

The distal end of the grease nipple 16 faces in a direction of the opening part 19, thereby, even in a state where the fixed scroll 3 is fastened to the casing 2, lubricant can be supplied to the orbiting bearing 12 and the auxiliary crank bearing 13C in a state where the fixed scroll 3 is attached to the casing 2, without having to remove the fixed scroll 3 from the casing 2. Accordingly, it is possible to improve the workability during maintenance. Furthermore, the orbiting scroll 4 is supported so as to be able to make the orbiting movement, so the grease nipple 16 needs not face the opening part 19 constantly. For example, there can be adopted a structure where when the drive shaft 9 is placed in a horizontal position, even if the grease nipple 16 does not face the opening part 19 when the orbiting scroll 4 is in a vertically highest position, the grease nipple 16 faces the opening part 19 when the orbiting scroll 4 is in a vertically lowest position.

When lubricant is supplied from the grease nipple 16 to the bearings, a tool for lubricant supply, such as a grease gun, can be put in the casing 2 from the opening part 19 to supply lubricant. Furthermore, when a grease gun or the like is used to supply lubricant, a nozzle of the grease gun and the grease nipple 16 do not always have to meet on respective axis lines, and lubricant can be supplied even when they are connected within some allowance for the angle. Therefore, within the allowance for the angle, the distal end of the grease nipple 16 can deviate from the direction of the opening part 19 when facing the opening part 19.

Here, the distal end of the grease nipple 16 is directed parallel to the direction of the cooling fins 4C. That is, the distal end of the grease nipple 16 is directed so that a straight line connecting the grease nipple 16 with the opening part 19 is located between two cooling fins 4C and also so that the straight line connecting the grease nipple 16 with the opening part 19 does not intersect with the cooling fins 4C. Accordingly, without a nozzle for grease supply hitting against the cooling fins during maintenance, lubricant can be supplied to the grease nipple 16.

Furthermore, the lubricant supply passage 17 and the grease nipple 16 are provided on the boss plate 5, thereby lubricant can be efficiency supplied to respective end surfaces of the auxiliary crank shaft 13A and the auxiliary crank bearing 13C on the side of the orbiting scroll 4 that are subjected to a large load in the self-rotation preventing mechanism 13. It is not necessary to provide any oil supply holes for supplying lubricant to the drive shaft 9, the auxiliary crank shaft 13A, etc.; therefore, there is no need to complicate an oil supply path. Accordingly, it is possible to suppress the degradation of reliability caused by air entering the oil supply path.

Figure 6:
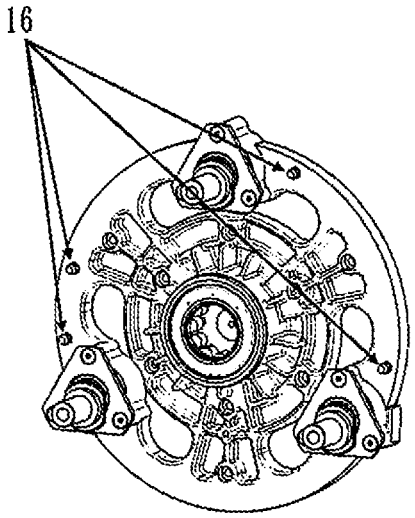
FIG. 6 is a perspective view of a boss plate according to a variation of Embodiment 1 of the present invention.
Figure 7:
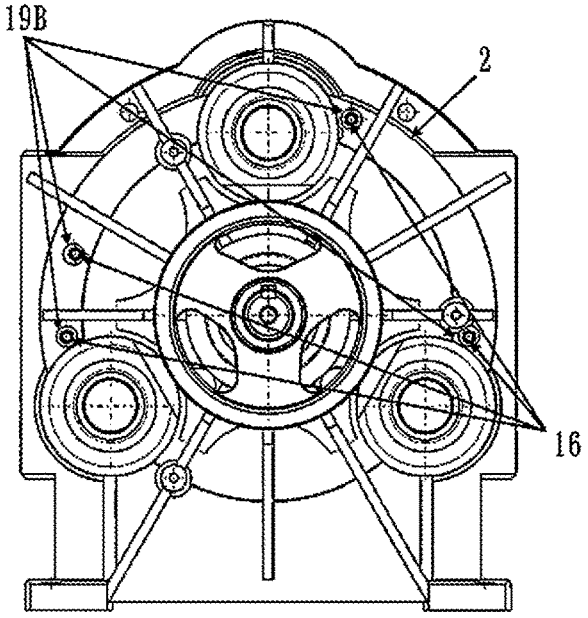
FIG. 7 is a back view of a compressor body according to the variation of Embodiment 1 of the present invention.

FIGS. 6 and 7 illustrate a variation of the present embodiment. In the variation of the present embodiment, as shown in FIG. 6, the grease nipple 16 faces in a direction of the back surface (the surface on the opposite side of the surface facing the fixed scroll 3) of the casing 2. Furthermore, as shown in FIG. 7, an opening part 19B is provided on the back surface of the casing 2. The grease nipple 16 is directed to face the side surface and the back surface, thereby the flexibility of the direction of supplying lubricant can be increased, and, for example, when there is an electric motor (not shown) on the side surface of the compressor body 1, lubricant can be easily supplied from the back surface.

As above, according to the present embodiment, the lubricant supply passage 17 and the grease nipple 16 are provided on the back surface (the surface on the side of the orbiting scroll 4) of the boss plate 5 as a piping for supplying lubricant to the orbiting bearing 12 and the auxiliary crank bearing 13C, and the distal end of the grease nipple 16 faces the direction of the opening part 19; therefore, it is possible to supply lubricant easily during maintenance. Furthermore, by providing the lubricant supply passage 17 and the grease nipple 16 on the back surface (the surface on the side of the orbiting scroll 4) of the boss plate 5 as a piping for supplying lubricant to the orbiting bearing 12 and the self-rotation preventing mechanism 13, lubricant can be efficiency supplied to the end surface on the side of the orbiting scroll 4 subjected to a large load in the self-rotation preventing mechanism 13. That is, according to the present embodiment, it is possible to improve the reliability and the workability.

Embodiment 2

A scroll-type compressor according to Embodiment 2 of the present invention is described with FIGS. 8 to 12. The same configuration as in Embodiment 1 is assigned the same reference numeral, and its description is omitted. The present embodiment is characterized in that a guide for grease supply is provided.

Figure 8:
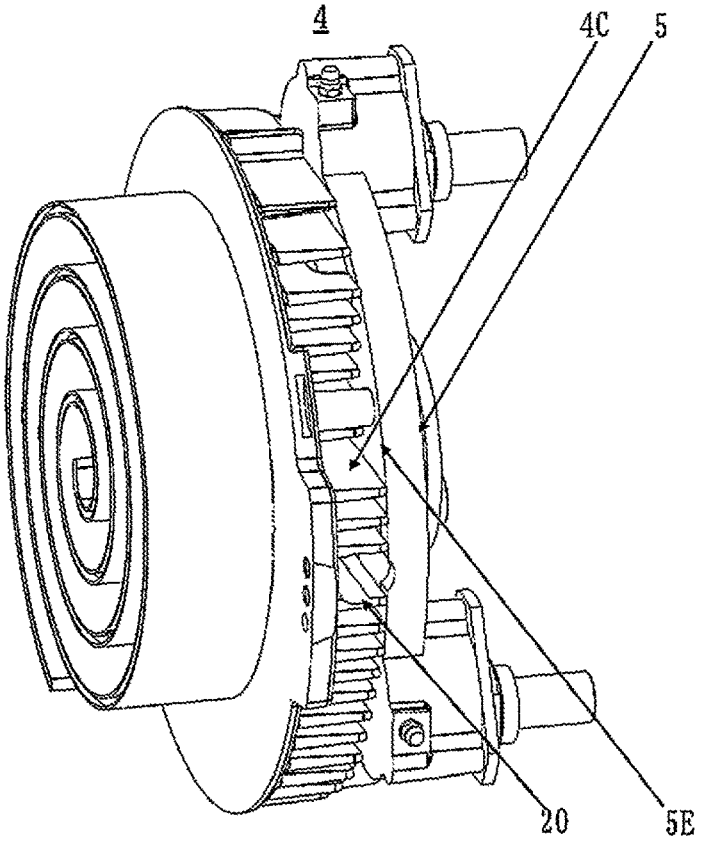
FIG. 8 is a perspective view of an orbiting scroll according to Embodiment 2 of the present invention.
Figure 9:
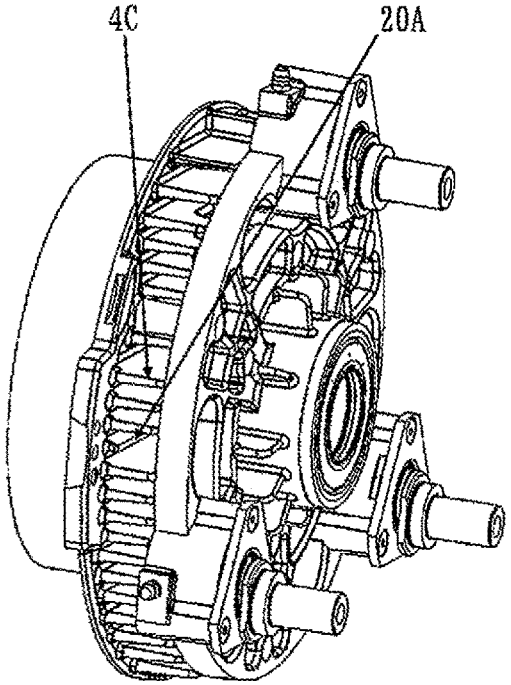
FIG. 9 is a perspective view of an orbiting scroll according to a variation of Embodiment 2 of the present invention.
Figure 10:
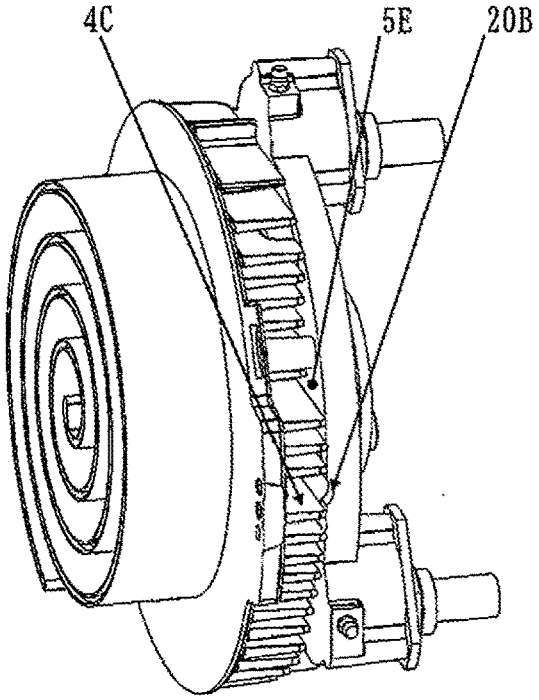
FIG. 10 is a perspective view of the orbiting scroll according to the variation of Embodiment 2 of the present invention.
Figure 11:
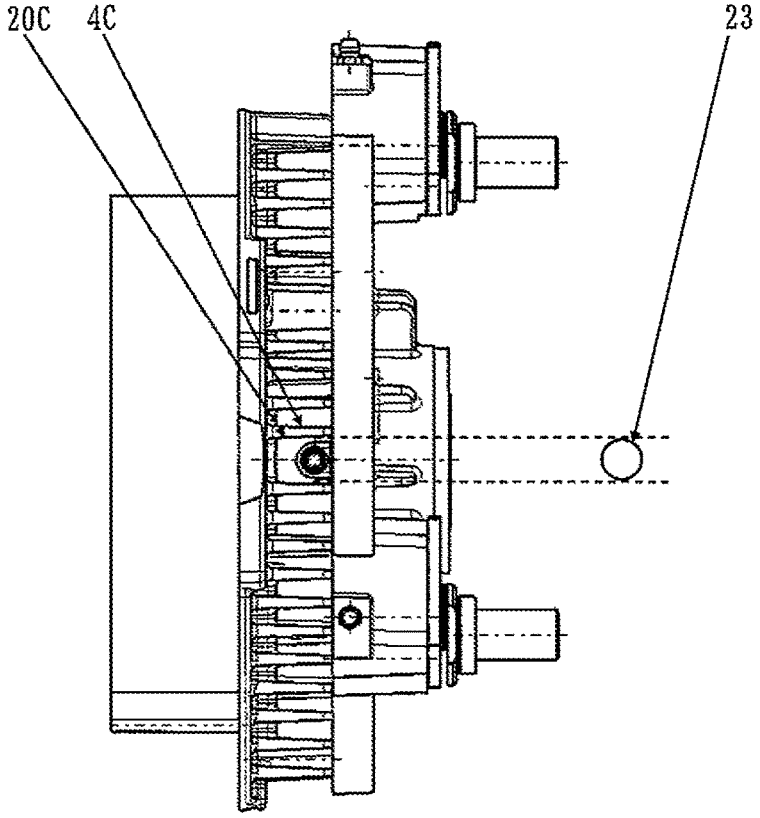
FIG. 11 is a perspective view of the orbiting scroll according to the variation of Embodiment 2 of the present invention.
Figure 12:
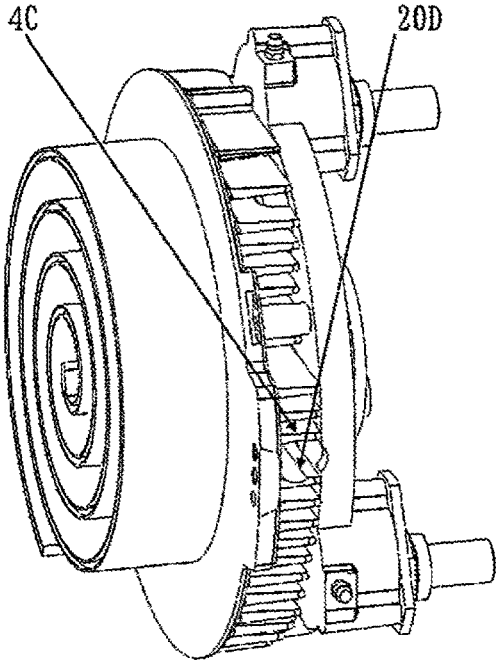
FIG. 12 is a perspective view of the orbiting scroll according to the variation of Embodiment 2 of the present invention.

FIG. 8 shows the orbiting scroll 4 in the present embodiment. In the present embodiment, a guide 20 along a nozzle for grease supply is formed on the cooling fins 4C on the back surface of the end plate 4A of the orbiting scroll 4. Accordingly, even when the grease nipple 16 installed on the back surface of the bearing boss 5A of the boss plate 5 is not be able to be visually observed, the supply of lubricant can be easily performed, and it is possible to improve the workability during maintenance.

FIGS. 9 to 12 show variations of the present embodiment. In the variation shown in FIG. 9, a guide 20A is formed by lowering a part of the cooling fins 4C. Furthermore, in the variation shown in FIG. 10, a guide 20B is formed by denting a portion of an end plate surface 5E of the boss plate 5. Accordingly, it is possible to form a guide easily. Moreover, in the variation shown in FIG. 11, a guide 20C is formed by adjusting the interval between the cooling fins 4C to fit with the diameter of a nozzle 23 of a grease gun. Furthermore, in the variation shown in FIG. 12, a guide 20D is formed by forming a notch on the distal end or the side surface or both of the distal end and the side surface of the cooling fin 4C, thereby the supply of grease can be performed more certainly.

As above, according to the present embodiment, the guide 20 along the nozzle for grease supply is formed, thereby the workability during maintenance can be further improved as compared with Embodiment 1.

Embodiment 3

Figure 13:
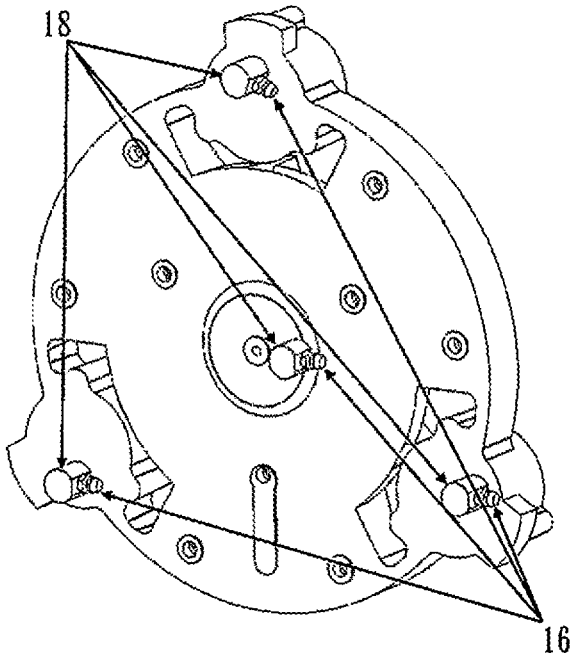
FIG. 13 is a perspective view of a boss plate according to Embodiment 3 of the present invention.

A scroll-type compressor according to Embodiment 3 of the present invention is described with FIG. 13. The same configuration as in Embodiment 1 is assigned the same reference numeral, and its description is omitted. The present embodiment is characterized in that a protrusion 18 is provided on the boss plate 5.

Figure 17:
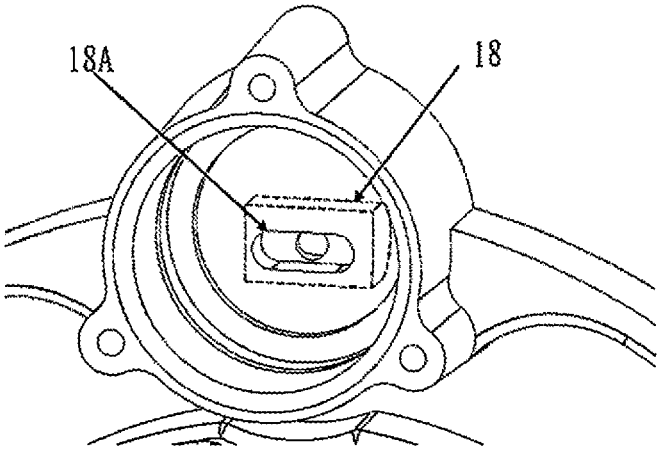
FIG. 17 is an enlarged perspective view of an auxiliary crank bearing boss according to Embodiment 3 of the present invention.

FIG. 13 shows the boss plate 5 in the present embodiment. The grease nipple 16 is installed on the protrusion 18 provided on the end plate surface 5E of the boss plate 5. FIG. 17 shows the bearing boss 5B in the present embodiment. By providing the protrusion 18, a grease reservoir 18A for storing lubricant inside the protrusion 18 can be formed. By forming the grease reservoir 18A, the amount of lubricant held in the bearing housing is increased, and the length of time between maintenance can be extended.

Figure 18:
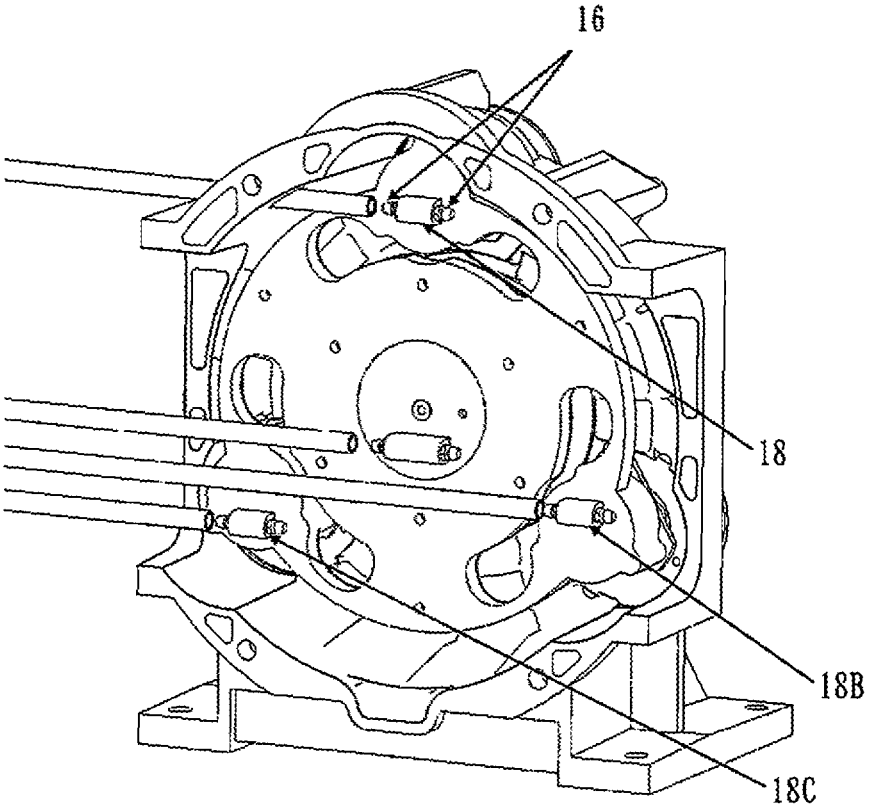
FIG. 18 is a perspective view of a compressor body according to a variation of Embodiment 3 of the present invention.

A variation of the present embodiment is described with FIG. 18. In the present embodiment, two grease nipples 16 facing different opening parts 19 are provided on one protrusion 18. That is, the lubricant supply passage 17 for supplying grease to the orbiting bearing 12 and the auxiliary crank bearing 13C has a plurality of distal ends that each supply lubricant, and the distal ends face directions of the different opening parts 19, respectively. Furthermore, for example, two or more protrusions 18 can be provided on the bearing boss 5A, and each of the protrusions 18 can be provided with a grease nipple 16 facing one of the different opening part 19. At this time, the protrusions 18 can be installed at different levels in the vertical direction, respectively. By providing two grease nipples on one protrusion 18, lubricant can be supplied from both the right and left in the drawing, which enables to work easily regardless of an installation environment. Then, a cooling-air windward-side protrusion part 18B and a leeward-side protrusion part 18C are installed at different levels in the vertical direction (positions not overlapping viewed from the opening part 19), respectively. Accordingly, lubricant can be supplied from either the right-hand opening part 19 or the left-hand opening part 19.

As above, according to the present embodiment, by providing the protrusion 18 on the boss plate 5, the reliability and the maintenance performance can be further improved as compared with Embodiments 1 and 2.

Embodiment 4

Figure 14:
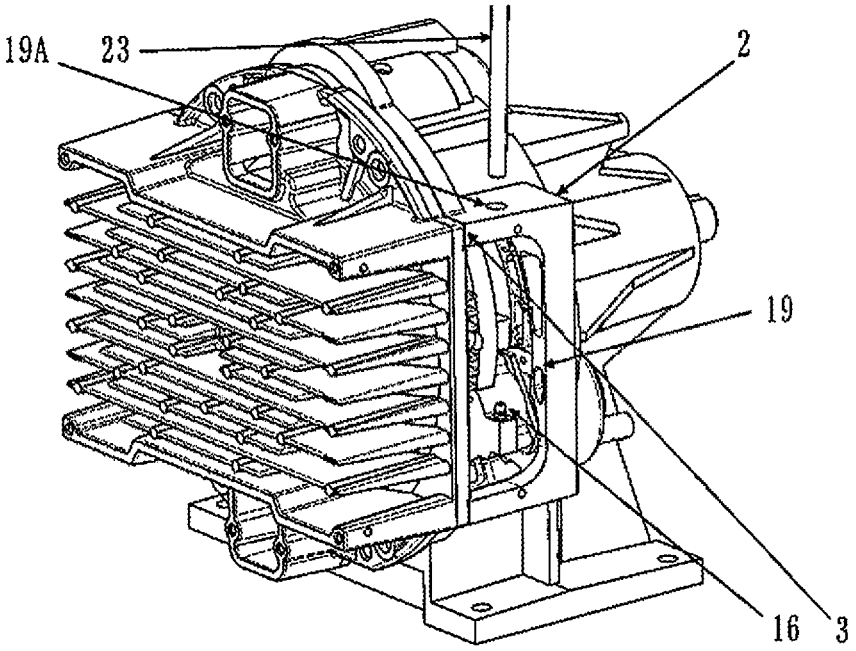
FIG. 14 is a perspective view of a compressor body according to Embodiment 4 of the present invention.
Figure 15:
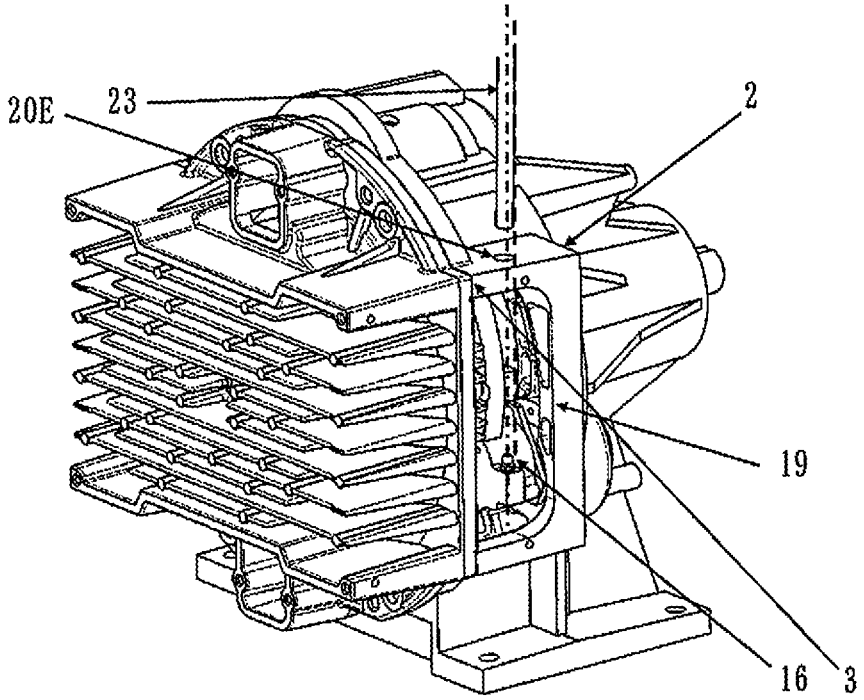
FIG. 15 is a perspective view of the compressor body according to Embodiment 4 of the present invention.
Figure 16:
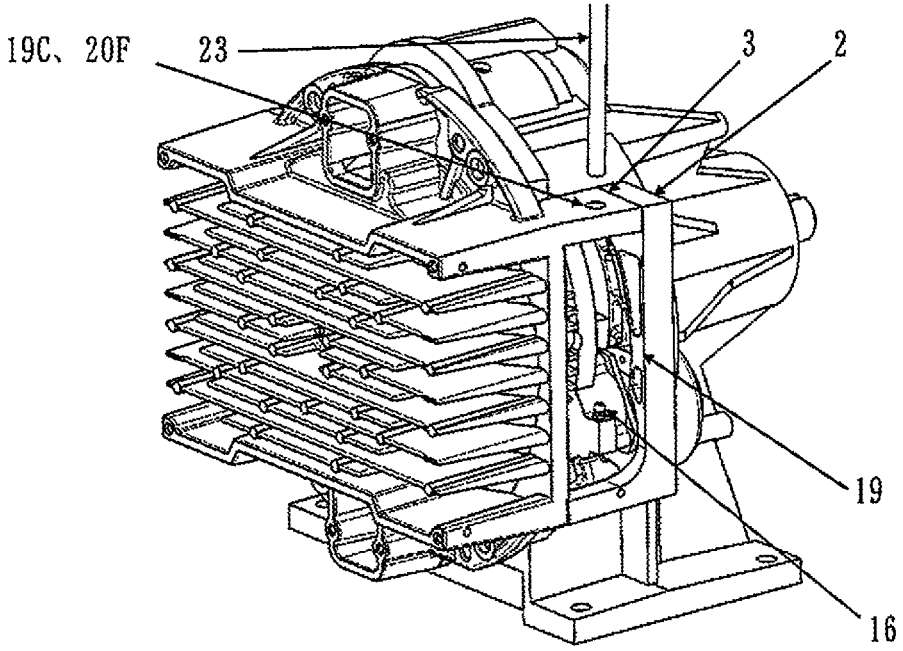
FIG. 16 is a perspective view of the compressor body according to Embodiment 4 of the present invention.

A scroll-type compressor according to Embodiment 4 of the present invention is described with FIGS. 14 to 16. The same configuration as in Embodiment 1 is assigned the same reference numeral, and its description is omitted.

FIG. 14 shows the compressor body 1 according to the present embodiment. In the present embodiment, besides the opening part 19 for cooling air supply of the casing 2, an opening part 19A is provided. In Embodiments 1 to 3, the opening part 19 doubles as an opening part for cooling air supply. When lubricant is supplied, a duct attached to the opening part 19 for cooling air supply need to be removed in some cases. On the other hand, in the present embodiment, the opening part 19A is provided in addition to the opening part 19; therefore, lubricant can be supplied without having to remove the duct, and the workability can be further improved. Furthermore, except for the time of maintenance, an easily-removable rubber cover or the like can be put on the opening part 19A. The installation of the rubber cover can prevent the leakage of cooling air from the opening part 19A when the compressor is in operation, and it is easy to remove the rubber cover, which will not diminish the workability.

In the present embodiment, when the grease nipple 16 and the nozzle 23 of the grease gun are installed so that their center lines are met as shown in FIG. 15, the opening part 19A is provided so that the side surface of the nozzle 23 of the grease gun is fit with the side surface of the opening part 19A. Accordingly, the opening part 19A can double as a guide 20E, and the supply of lubricant can be easily performed. Furthermore, as shown in FIG. 16, instead of the casing 2, an opening part 19C is provided on the fixed scroll 3, and can double as a guide 20F by adjusting its position just like the guide 20E, and the supply can be easily performed.

As above, according to the present embodiment, the opening part 19A is provided in addition to the opening part 19 for cooling air supply, thereby the workability can be further improved as compared with Embodiments 1 to 3.

Embodiment 5

Figure 19:
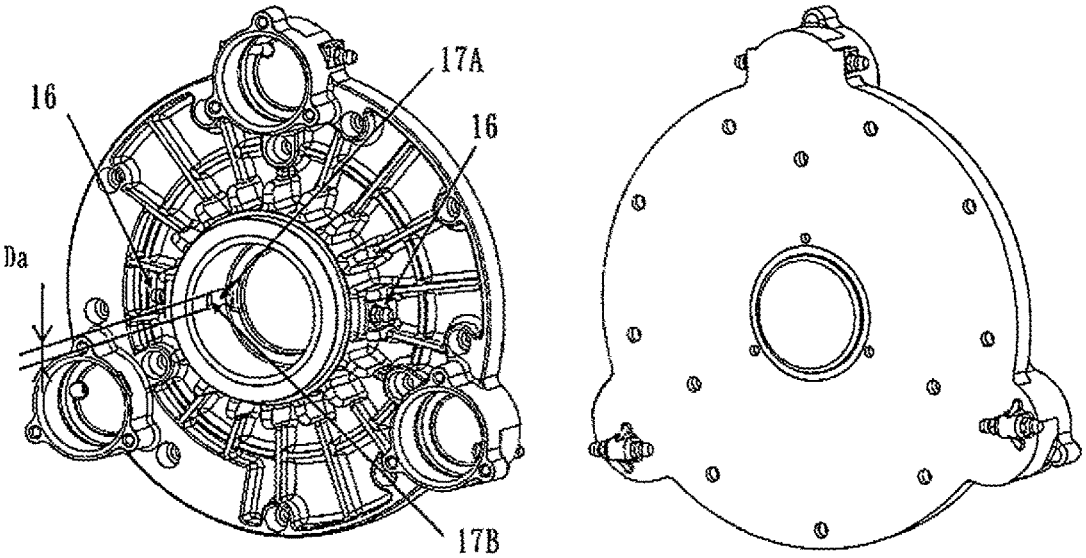
FIG. 19 is a perspective view of a boss plate according to Embodiment 5 of the present invention.
Figure 20:
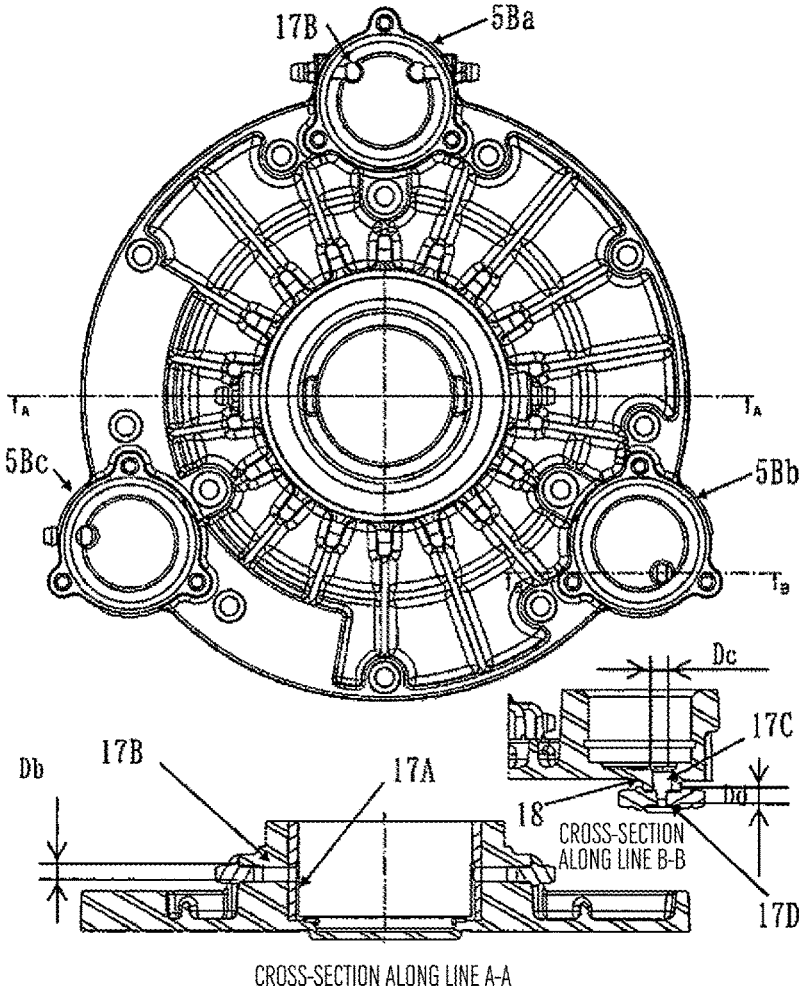
FIG. 20 is a front view and a cross-sectional view of the boss plate according to Embodiment 5 of the present invention.
Figure 21:
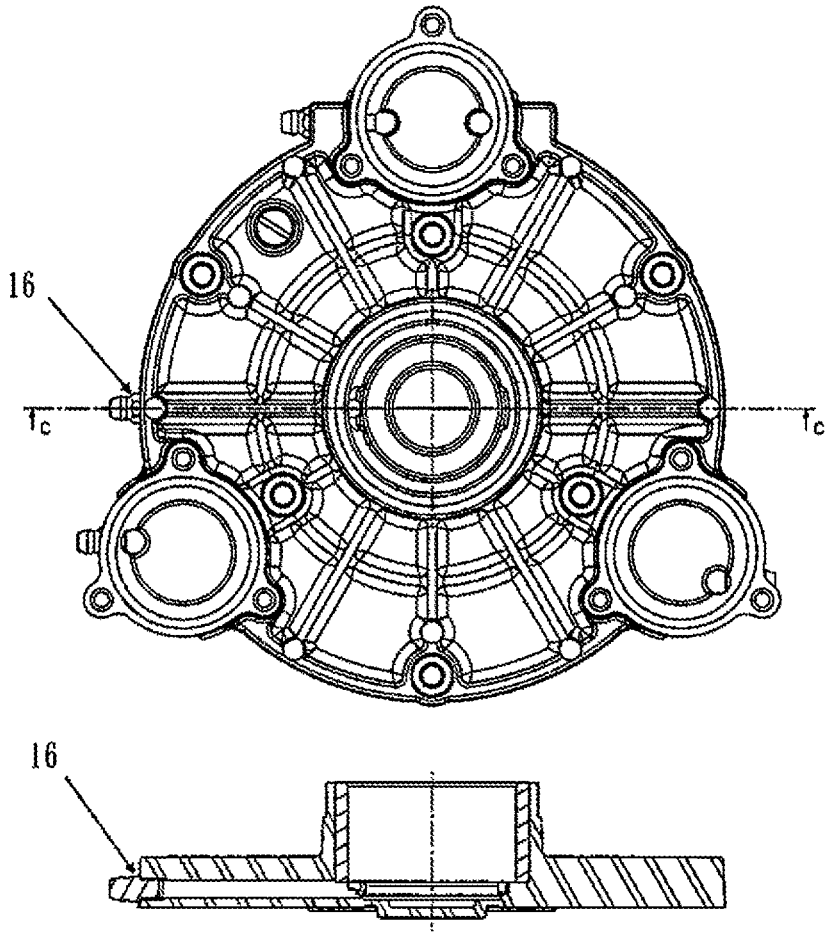
FIG. 21 is a front view and a cross-sectional view of a boss plate according to a variation of Embodiment 5 of the present invention.

A scroll-type compressor according to Embodiment 5 of the present invention is described with FIGS. 19 to 21. The same configuration as in Embodiment 1 is assigned the same reference numeral, and its description is omitted.

FIG. 19 shows a perspective view of the boss plate 5 according to the present embodiment; FIG. 20 shows a front view and a cross-sectional view of the boss plate 5 according to the present embodiment; FIG. 21 shows a front view and a cross-sectional view of the boss plate 5 according to a variation of the present embodiment. In the present embodiment, to supply lubricant to the orbiting bearing 12, the grease nipple 16 facing the opening part 19 is provided on the side surface (the outer periphery) of the bearing boss 5A. By providing the grease nipple 16 on the side surface of the bearing boss 5A, a gap for the passage of the nozzle of the grease gun needs not to be provided in the cooling fins 4C of the orbiting scroll 4, and the larger cooling area can be secured, and the cooling efficiency of the orbiting scroll 4 can be improved. Furthermore, the grease nipple 16 is provided on the side surface (the outer periphery) of the bearing boss 5A, and therefore, a depressed part 17A serving as the lubricant supply passage 17 facing in the axial direction of the orbiting bearing 12 is provided on the inner periphery of the bearing boss 5A. This depressed part 17A can be formed by casting into a mold, or can be provided by cutting. As shown in FIGS. 19 and 20, a width Da of this depressed part 17A in the circumferential direction is larger than a diameter Db of a lubricant supply passage 17B from the grease nipple 16, thereby it is possible to prevent the occurrence of burrs when the lubricant supply passage 17B is formed with a drill or the like, and the processability is improved, and therefore the productivity is improved. Moreover, lubricant can be stored in the depressed part 17A, and the length of time to maintenance can be extended.

As for the bearing boss 5B of the auxiliary crank bearing 13C, a bearing boss 5Ba on the upper side in the drawing is provided just like the bearing boss 5A, and a plurality of grease nipples 16 are provided on the side surface (the outer periphery) of the bearing boss 5Ba. Furthermore, a depressed part 17C serving as the lubricant supply passage 17 is provided on the bottom surface of the bearing boss 5Ba. Moreover, as for bearing bosses 5Bb and 5Bc on the right and left in the drawing, a protrusion 18 is provided on the back surface (the surface on the side of the orbiting scroll 4) of the boss plate 5, and the depressed part 17C serving as the lubricant supply passage 17 is provided inside the protrusion 18. A diameter Dc of the lubricant supply passage 17C is larger than a diameter Dd of an attachment female screw part 17D for attachment of the grease nipple 16. Accordingly, it is possible to prevent the occurrence of burrs when the attachment female screw part 17D is formed with a drill or the like, and the processability is improved, and therefore the productivity is improved. Furthermore, lubricant can be stored in the depressed part 17C, and the length of time to maintenance can be extended.

Moreover, as shown in FIG. 21, to supply lubricant to the orbiting bearing 12, the grease nipple 16 facing the opening part 19 can be provided on the side surface of the boss plate 5. By providing the grease nipple 16 on the side surface of the boss plate 5, lubricant can be supplied while visually observing the grease nipple 16, and the workability is improved. Furthermore, the longer lubricant supply passage 17 can be secured, and lubricant can be stored, and then the length of time to maintenance can be extended.

The embodiments described above are all just an example of embodiments to implement the present invention, and the technical scope of the present invention is not limitedly interpreted in terms of these. That is, the present invention can be embodied in various forms without departing from the technological thoughts or principal features of the invention. Furthermore, the present invention can be implemented by a combination of multiple embodiments.

REFERENCE SIGNS LIST

1 Compressor body
2 Casing
2A Tube part
2B Bottom part
2C Bearing attachment part
2D Bearing boss
3 Fixed scroll
3A End plate
3B Lap part
3C Support part
4 Orbiting scroll (scroll member)
4A End plate
4B Lap part
4C Cooling fin
5 Boss plate
5A Bearing boss (orbiting bearing)
5B Bearing boss (auxiliary crank bearing)
5Ba Upper bearing boss
5Bb Right bearing boss
5Bc Left bearing boss
5C Fastening part (boss plate)
5D Fastening bolt
5E End plate surface
6 Compression chamber
7 Intake port
7A Air intake filter
8 Discharge port
9 Drive shaft
10 Crank part
11 Balance weight
12 Orbiting bearing
13 Self-rotation preventing mechanism
13A Auxiliary crank shaft
13B Auxiliary crank bearing
13C Auxiliary crank bearing
13D Pressure plate
13E Countersunk bolt
13F Seal member (auxiliary crank bearing)
13G Outer ring
14 Discharge piping (discharge passage)
15 Seal member (orbiting bearing)
16 Grease nipple
17 Lubricant supply passage
17A Depressed part
17B Lubricant supply passage
17C Lubricant supply passage
17D Lubricant supply passage
18 Protrusion
18A Grease reservoir
18B Windward-side protrusion
18C Leeward-side protrusion
19 Opening part
19A Casing-side opening part
19B Casing-back-surface opening part

19C Fixed-scroll opening part
20 Guide
20A Cooling-fin guide
20B Boss-plate guide
20C Cooling-fin interval guide
20D Cooling-fin notch guide
20E Casing guide
20F Fixed-scroll guide
21, 22 Bearing
23 Grease gun nozzle

The invention claimed is:

1. A scroll-type fluid machine comprising:
a fixed scroll;
an orbiting scroll that faces the fixed scroll and makes orbiting movement;
a casing that is provided on radially outside of the orbiting scroll;
a drive shaft that drives the orbiting scroll;
an orbiting bearing that supports the drive shaft with respect to the orbiting scroll; and
a piping that supplies lubricant to the orbiting bearing, wherein
the orbiting scroll is provided with a boss plate that is attached to the drive shaft, the piping is provided on the boss plate, and an end of the piping faces an opening provided between the casing and the fixed scroll or an opening provided on the fixed scroll or the casing, and
a plurality of cooling fins are formed on the orbiting scroll, and
a straight line connecting an end of the piping with an opening provided between the casing and the fixed scroll is located between two cooling fins, and
the straight line connecting the end of the piping with the opening does not intersect with the plurality of cooling fins.

2. The scroll-type fluid machine according to claim 1, wherein the opening is provided on a side surface of the casing or a surface of the casing on an opposite side of a surface facing the fixed scroll.

3. The scroll-type fluid machine according to claim 1, wherein a guide for grease supply is provided on a surface of the boss plate on a side of the orbiting scroll or a surface of the orbiting scroll on an opposite side of a surface facing the fixed scroll, the guide being provided from the opening toward the piping.

4. The scroll-type fluid machine according to claim 1, wherein a notch is provided on a cooling fin formed on the orbiting scroll.

5. The scroll-type fluid machine according to claim 1, wherein a notch is provided on the casing.

6. The scroll-type fluid machine according to claim 1, wherein a protrusion is provided on the boss plate, and the piping projects from the protrusion.

7. The scroll-type fluid machine according to claim 6, wherein a grease reservoir for storing lubricant is provided in the protrusion.

8. The scroll-type fluid machine according to claim 1, wherein the piping has a plurality of ends facing in different directions, respectively, and lubricant is supplied from the plurality of ends.

9. The scroll-type fluid machine according to claim 1, wherein
the boss plate has a bearing boss to which 1 an end of the drive shaft is attached, and the piping is provided on a side surface of the bearing boss on a side of an outer periphery.

10. The scroll-type fluid machine according to claim 9, wherein a depressed part is provided on a side surface of the bearing boss on a side of an inner periphery.

11. The scroll-type fluid machine according to claim 1, wherein the piping is provided on a side surface of the boss plate.

12. A scroll-type fluid machine comprising:
a fixed scroll;
an orbiting scroll that faces the fixed scroll and makes orbiting movement;
a casing that is provided on radially outside of the orbiting scroll;
a drive shaft that drives the orbiting scroll; and
a self-rotation preventing mechanism that prevents self-rotation of the orbiting scroll, wherein
a boss plate attached to the drive shaft is provided on a surface of the orbiting scroll on an opposite side of a surface facing the fixed scroll,
a piping for supplying lubricant to the self-rotation preventing mechanism is provided on the boss plate,
a plurality of cooling fins are formed on the orbiting scroll,
a straight line connecting an end of the piping with an opening provided between the casing and the fixed scroll is located between two cooling fins, and
the straight line connecting the end of the piping with the opening does not intersect with the plurality of cooling fins.

13. The scroll-type fluid machine according to claim 12, wherein the opening is provided on a side surface of the casing or a surface of the casing on an opposite side of a surface facing the fixed scroll.

14. The scroll-type fluid machine according to claim 12, wherein a guide for grease supply is provided on a surface of the boss plate on a side of the orbiting scroll or a surface of the orbiting scroll on an opposite side of a surface facing the fixed scroll, the guide being provided from the opening toward the piping.

15. The scroll-type fluid machine according to claim 12, wherein a notch is provided on a cooling fin formed on the orbiting scroll.

16. The scroll-type fluid machine according to claim 12, wherein a notch is provided on the casing.

17. The scroll-type fluid machine according to claim 12, wherein a protrusion is provided on the boss plate, and the piping projects from the protrusion.

18. The scroll-type fluid machine according to claim 17, wherein a grease reservoir for storing lubricant is provided in the protrusion.

19. The scroll-type fluid machine according to claim 12, wherein the piping has a plurality of ends facing in different directions, respectively, and lubricant is supplied from the plurality of ends.

20. The scroll-type fluid machine according to claim 12, comprising a plurality of pipings, wherein respective ends of the plurality of pipings are provided at positions not overlapping one another viewed from the opening.

21. The scroll-type fluid machine according to claim 12, wherein
the boss plate has a bearing boss that houses the self-rotation preventing mechanism, and a depressed part is provided on a bottom surface of the bearing boss.

* * * * *